US005604941A

United States Patent [19]

Román

[11] Patent Number: 5,604,941

[45] Date of Patent: Feb. 25, 1997

[54] PORTABLE CRIB FOR A SOFA

[76] Inventor: Edward Román, 2265 N. Howard St., Philadelphia, Pa. 19133

[21] Appl. No.: 553,047

[22] Filed: Nov. 3, 1995

[51] Int. Cl.[6] ..... A47D 7/04

[52] U.S. Cl. ..... 5/95; 5/93.1; 5/93.2; 5/94

[58] Field of Search ..... 5/98.1, 99.1, 93.2, 5/174

[56] References Cited

U.S. PATENT DOCUMENTS

| | | | |
|---|---|---|---|
| 111,365 | 1/1871 | McArthur | 5/95 |
| 534,258 | 2/1895 | Froehlich | 5/93.1 |
| 542,759 | 7/1895 | Froehlich | 5/93.1 |
| 677,717 | 7/1901 | Thomne | 5/99.1 |
| 5,148,561 | 9/1992 | Tharalson et al. | 5/99.1 |
| 5,161,269 | 11/1992 | McLean et al. | 5/93.1 |
| 5,172,435 | 12/1992 | Griffin et al. | 5/98.1 |
| 5,243,718 | 9/1993 | Shamie | 5/99.1 |
| 5,379,469 | 1/1995 | Mills et al. | 5/99.1 |

*Primary Examiner*—Steven N. Meyers
*Assistant Examiner*—Fredrick Conley

[57] ABSTRACT

A portable crib for a sofa including a front section comprised of an inner gate and an outer gate. The inner gate is slidably received within the outer gate. The device includes a pair of side sections. Each of the side sections is comprised of an inner gate and an outer gate. The inner gate is slidably received within the outer gate. Each outer gate is secured to the inner gate and the outer gate of the front section. A sofa securement mechanism is hingedly coupled with a lower distal end of each of the inner gate and the outer gate of the front section.

7 Claims, 3 Drawing Sheets

PORTABLE CRIB FOR A SOFA

BACKGROUND OF THE INVENTION

1. Field of the Invention

The present invention relates to a portable crib for a sofa and more particularly pertains to forming a crib mountable to cushions of a sofa with a portable crib for a sofa.

2. Description of the Prior Art

The use of portable cribs is known in the prior art. More specifically, portable cribs heretofore devised and utilized for the purpose of folding into a compact self-supported unit are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,819,285 to Fetters discloses a portable collapsible baby crib.

U.S. Pat. No. 4,765,004 to Kessel discloses a folding portable crib.

U.S. Pat. No. Design 316,339 to Taylor discloses the ornamental design for a portable collapsible crib.

U.S. Pat. No. 4,692,953 to Fetters discloses a portable collapsible baby crib.

U.S. Pat. No. Design 294,894 to D'Arcy et al. discloses the ornamental design for a portable crib.

While these devices fulfill their respective, particular objective and requirements, the aforementioned patents do not describe a portable crib for a sofa for forming a crib mountable to cushions of a sofa.

In this respect, the portable crib for a sofa according to the present invention substantially departs from the conventional concepts and designs of the prior art, and in doing so provides an apparatus primarily developed for the purpose of forming a crib mountable to cushions of a sofa.

Therefore, it can be appreciated that there exists a continuing need for new and improved portable crib for a sofa which can be used for forming a crib mountable to cushions of a sofa. In this regard, the present invention substantially fulfills this need.

SUMMARY OF THE INVENTION

In the view of the foregoing disadvantages inherent in the known types of portable cribs now present in the prior art, the present invention provides an improved portable crib for a sofa. As such, the general purpose of the present invention, which will be described subsequently in greater detail, is to provide a new and improved portable crib for a sofa and method which has all the advantages of the prior art and none of the disadvantages.

To attain this, the present invention essentially comprises a mattress having a generally square configuration. The mattress is positionable on an upper surface of a sofa cushion. The device includes a front section comprised of an inner gate and an outer gate. The inner gate is slidably received within the outer gate. The outer gate has an aperture formed through an upper surface thereof adjacent to an open end thereof where the outer gate slidably receives the inner gate. An adjustment knob extends through the aperture to secure the inner gate within the outer gate at a desired length. Distal ends of the inner gate and the outer gate have vertical slots formed therein. The device includes a pair of side sections. Each of the side sections is comprised of an inner gate and an outer gate. The inner gate is slidably received within the outer gate. The outer gate has an aperture formed through an upper surface thereof adjacent to an open end thereof where the outer gate slidably receives the inner gate. An adjustment knob extends through the aperture to secure the inner gate within the outer gate at a desired length. Each outer gate has a hook and loop strip on the upper surface thereof. Each outer gate has securement portions slidably secured within the vertical slots in the distal ends of the inner gate and the outer gate of the front section. The device includes a sofa securement mechanism comprised of a pair of upper L-shaped brackets each having a vertical extent and a horizontal extent. The vertical extent is hingedly coupled with a lower distal end of each of the inner gate and the outer gate of the front section. The vertical extent has a receiving channel formed therein. An aperture extends through a side of the vertical extent into the receiving channel. The sofa securement mechanism has a pair of lower L-shaped brackets each having a vertical extent and a horizontal extent. The vertical extent is slidably coupled with the receiving channel. The sofa securement mechanism has a pair of adjustment knobs each extending through the aperture to secure the lower L-shaped bracket within the upper L-shaped brackets at a desired length. A carrying case is adapted to receive the portable crib in a disassembled configuration.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable crib for a sofa which has all the advantages of the prior art portable cribs and none of the disadvantages.

It is another object of the present invention to provide a new and improved portable crib for a sofa which may be easily and efficiently manufactured and marketed.

It is a further object of the present invention to provide a new and improved portable crib for a sofa which is of durable and reliable construction.

An even further object of the present invention is to provide a new and improved portable crib for a sofa which is susceptible of a low cost of manufacture with regard to both materials and labor, and which accordingly is then susceptible of low prices of sale to the consuming public, thereby making such a portable crib for a sofa economically available to the buying public.

Still yet another object of the present invention is to provide a new and improved portable crib for a sofa which provides in the apparatuses and methods of the prior art some of the advantages thereof, while simultaneously overcoming some of the disadvantages normally associated therewith.

Even still another object of the present invention is to provide a new and improved portable crib for a sofa for forming a crib mountable to cushions of a sofa.

Lastly, it is an object of the present invention to provide a new and improved portable crib for a sofa including a front section comprised of an inner gate and an outer gate. The inner gate is slidably received within the outer gate. The device includes a pair of side sections. Each of the side sections is comprised of an inner gate and an outer gate. The inner gate is slidably received within the outer gate. Each outer gate is secured to the inner gate and the outer gate of the front section. A sofa securement mechanism is hingedly coupled with a lower distal end of each of the inner gate and the outer gate of the front section.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
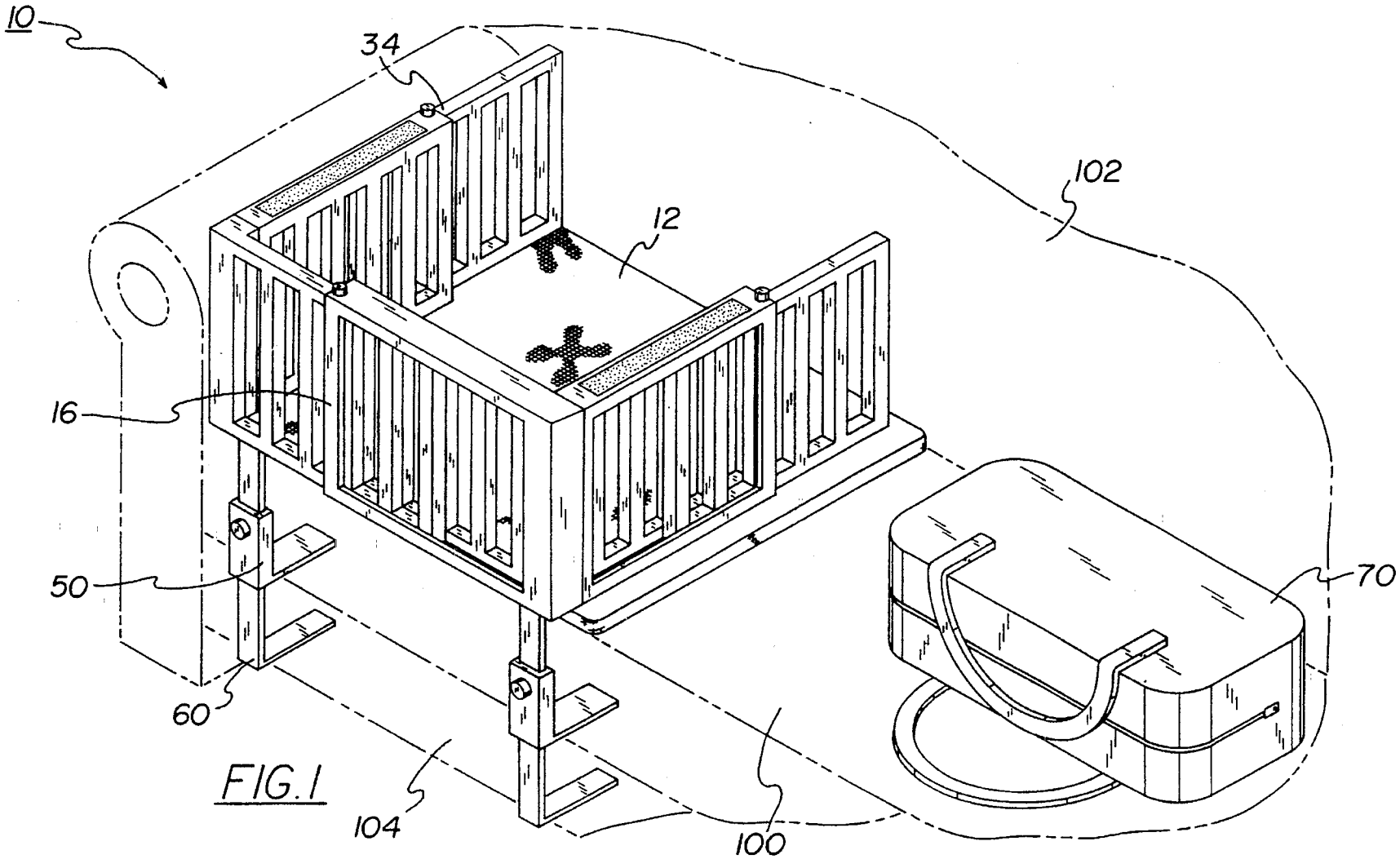
FIG. 1 is a perspective view of the preferred embodiment of the portable crib for a sofa constructed in accordance with the principles of the present invention.
Figure 2:
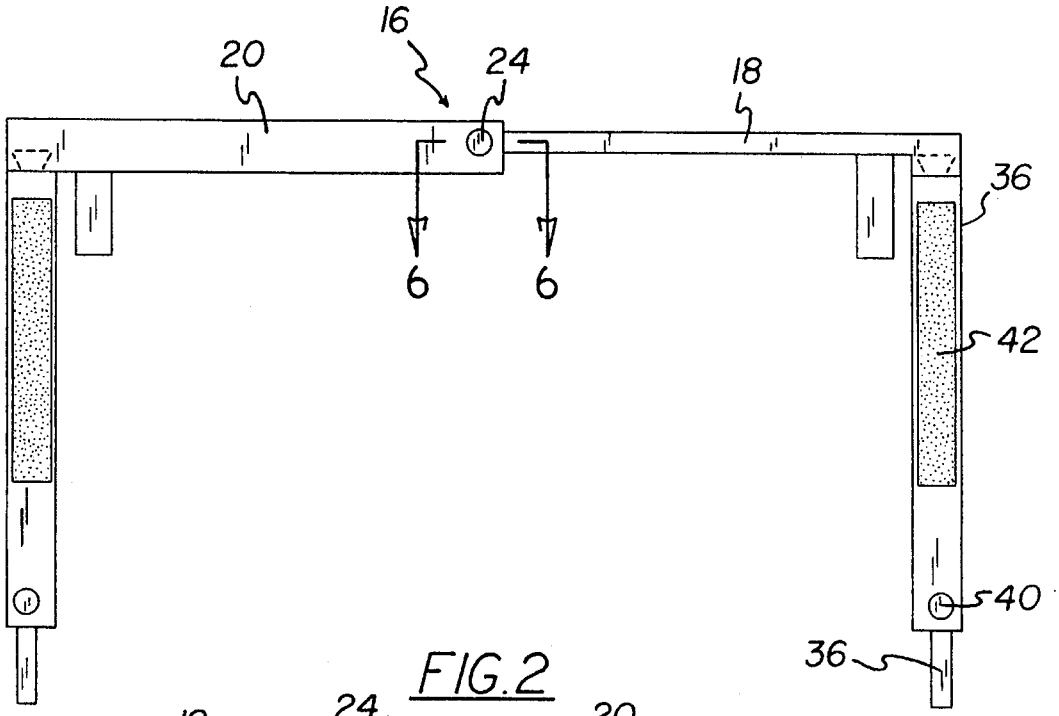
FIG. 2 is a plan view of the preferred embodiment of the present invention.
Figure 3:
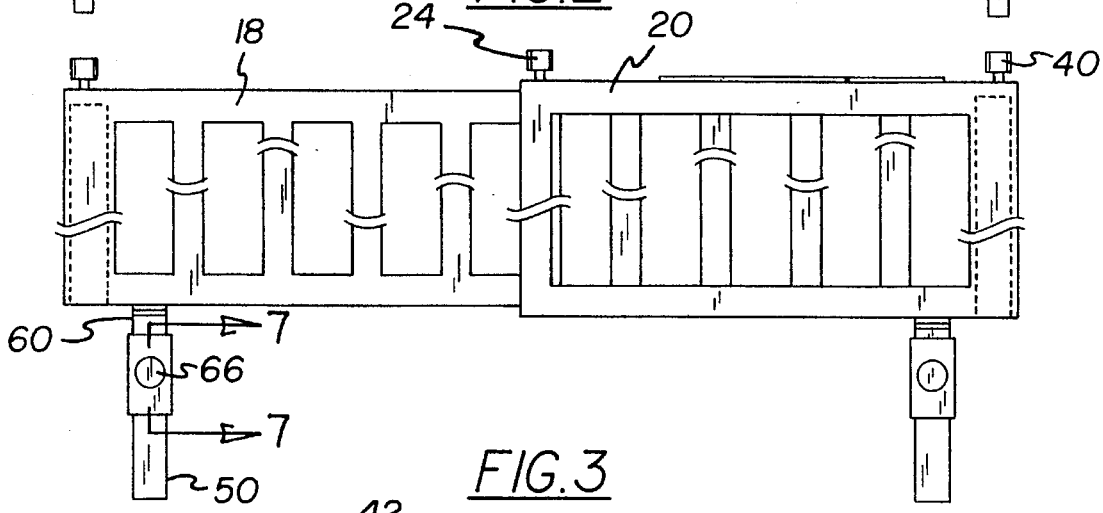
FIG. 3 is a front elevation view of the present invention.
Figure 4:
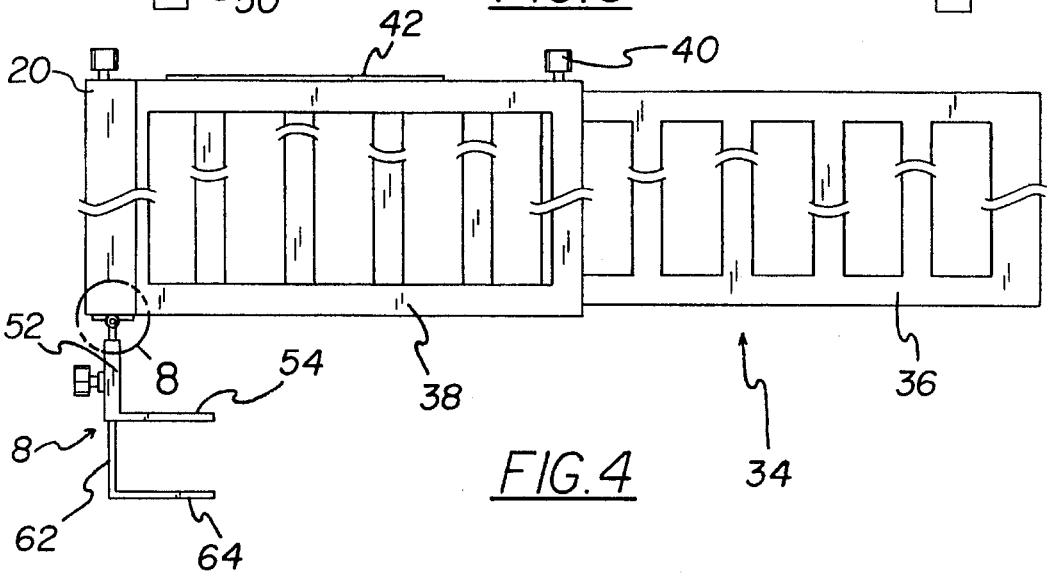
FIG. 4 is a side elevation view of the present invention.
Figure 5:
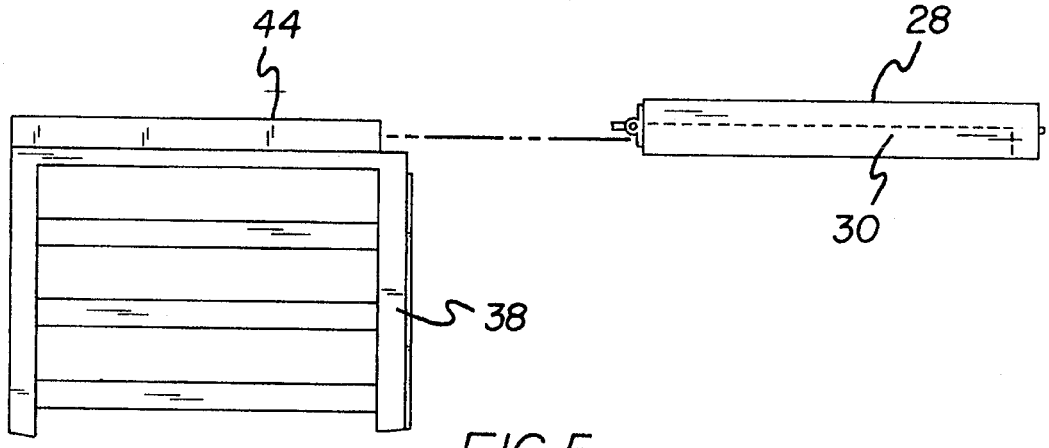
FIG. 5 is a plan view illustrating the coupling of the railings.
Figure 6:
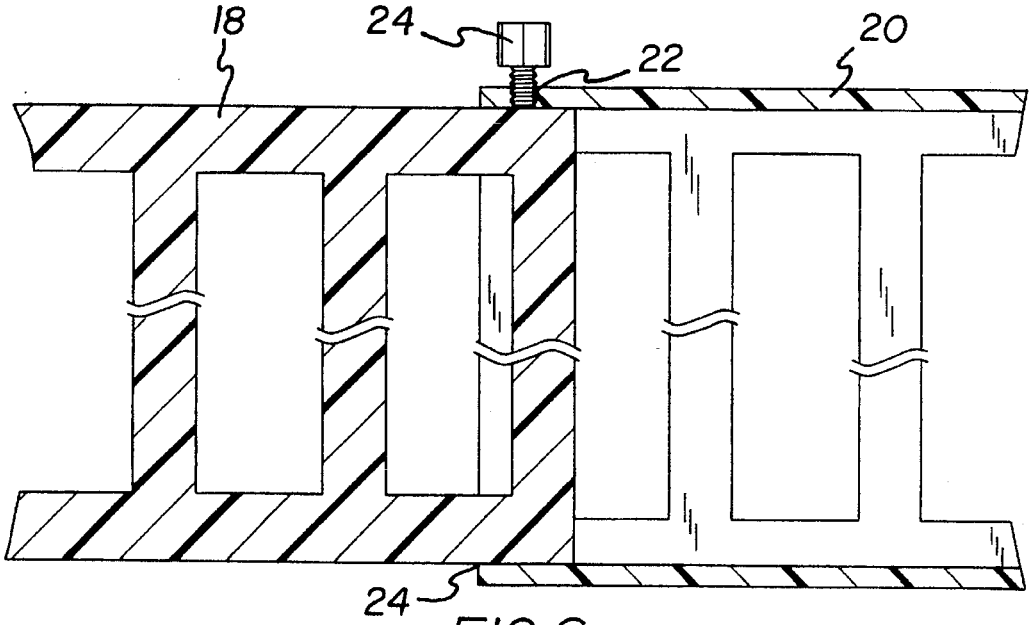
FIG. 6 is a cross-sectional view as taken along line 6—6 of FIG. 2.
Figure 7:
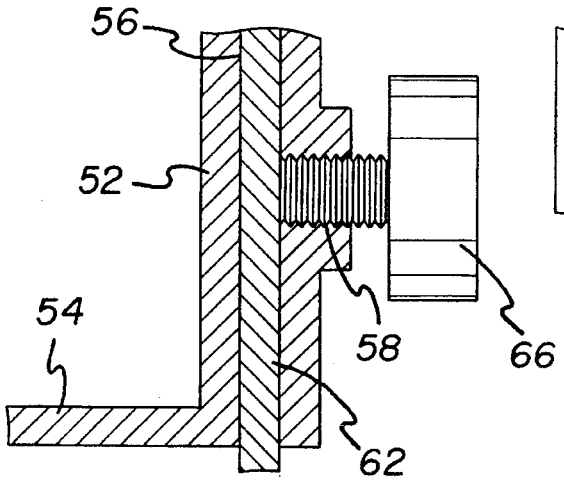
FIG. 7 is a cross-sectional view as taken along line 7—7 of FIG. 3.
Figure 8:
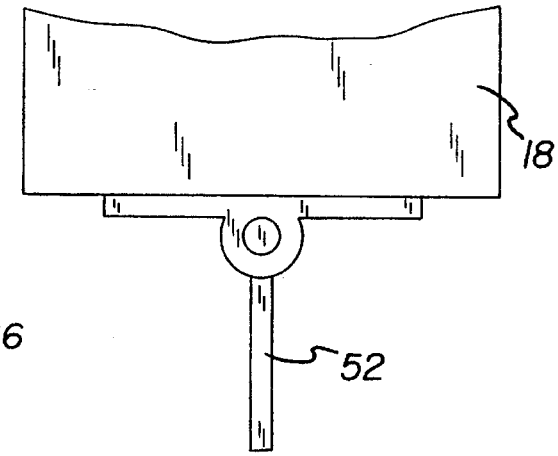
FIG. 8 is an enlarged view of the hinged coupling of the present invention.

With reference now to the drawings, and in particular, to FIGS. 1–8 thereof, the preferred embodiment of the new and improved portable crib for a sofa embodying the principles and concepts of the present invention and generally designated by the reference number 10 will be described.

Specifically, it will be noted in the various Figures that the device relates to a new and improved portable crib for a sofa for forming a crib mountable to cushions of a sofa. In its broadest context, the device consists of a mattress, a front section, a pair of side sections, a sofa securement mechanism, and a carrying case. Such components are individually configured and correlated with respect to each other so as to attain the desired objective.

The device 10 includes a mattress 12 having a generally square configuration. The mattress 12 is positionable on an upper surface 100 of a sofa cushion 102. The mattress 12 is fabricated of a waterproof material. The mattress 12 is used to place an infant thereon to protect the sofa cushion underneath from becoming soiled.

The device 10 includes a front section 16 comprised of an inner gate 18 and an outer gate 20. The inner gate 18 is slidably received within the outer gate 20. Both the inner gate 18 and the outer gate 20 are constructed of an outer frame having vertical rails extending therebetween in a spaced relationship. The outer gate 20 has an aperture 22 formed through an upper surface thereof adjacent to an open end 24 thereof where the outer gate 20 slidably receives the inner gate 18. An adjustment knob 26 extends through the aperture 22 to secure the inner gate 18 within the outer gate 20 at a desired length. This feature allows for a user to adjust the length of the front section 16 depending upon the available area or the size of the infant. Distal ends 28 of the inner gate 18 and the outer gate 20 have vertical slots 30 formed therein.

The device 10 includes a pair of side sections 34. Each of the side sections 34 is comprised of an inner gate 36 and an outer gate 38. The inner gate 36 is slidably received within the outer gate 38. Both the inner gate 36 and the outer gate 38 are constructed of an outer frame having vertical rails extending therebetween in a spaced relationship. The outer gate 38 has an aperture formed through an upper surface thereof adjacent to an open end thereof where the outer gate 38 slidably receives the inner gate 36. An adjustment knob 40 extends through the aperture to secure the inner gate 36 within the outer gate 38 at a desired length. This feature allows for a user to adjust the length of the pair of side sections 34 depending upon the available area on the sofa 102 or the size of the infant. Each outer gate 38 has a hook and loop strip 42 on the upper surface thereof. The hook and loop strip 42 allows for the user to attach toys or baby bottles to the device 10 to be accessed by the infant or baby. Each outer gate 38 has securement portions 44 slidably secured within the vertical slots 30 in the distal ends 28 of the inner gate 18 and the outer gate 20 of the front section 16. The securement portions 44 can be simply detached from the vertical slots 30 to disassemble the device 10 when not in use.

The device 10 includes a sofa securement mechanism 48 comprised of a pair of upper L-shaped brackets 50 each having a vertical extent 52 and a horizontal extent 54. The vertical extent 52 is hingedly coupled with a lower distal end of each of the inner gate 18 and the outer gate 20 of the front section 16. The vertical extent 52 has a receiving channel 56 formed therein. An aperture 58 extends through a side of the vertical extent 52 into the receiving channel 56. The horizontal extents 54 are positioned between a lower end of the sofa cushions 100 and the sofa's lower base end 104. The sofa securement mechanism 48 has a pair of lower L-shaped brackets 60 each having a vertical extent 62 and a horizontal extent 64. The vertical extent 62 is slidably coupled with the receiving channel 56. The sofa securement mechanism 48 has a pair of adjustment knobs 66 each extending through the aperture 58 to secure the lower L-shaped bracket 60 within the upper L-shaped bracket 50 at a desired length. The horizontal extent 64 is positionable beneath the lower base end 104 of the sofa 102.

A carrying case 70 is adapted to receive the portable crib in a disassembled configuration. The carrying case 70 can be fabricated out of canvas or plastic material with indicia thereon to advertise the device 10.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A portable crib for a sofa for forming a crib mountable to cushions of a sofa comprising, in combination:

a mattress having a generally square configuration, the mattress positionable on an upper surface of a sofa cushion;

a front section comprised of an inner gate and an outer gate, the inner gate being slidably received within the outer gate, the outer gate having an aperture formed through an upper surface thereof adjacent to an open end thereof where the outer gate slidably receives the inner gate, an adjustment knob extends through the aperture to secure the inner gate within the outer gate at a desired length, distal ends of the inner gate and the outer gate having vertical slots formed therein;

a pair of side sections, each of the side sections comprised of an inner gate and an outer gate, the inner gate being slidably received within the outer gate, the outer gate having an aperture formed through an upper surface thereof adjacent to an open end thereof where the outer gate slidably receives the inner gate, an adjustment knob extends through the aperture to secure the inner gate within the outer gate at a desired length, each outer gate having a hook and loop strip on the upper surface thereof, each outer gate having securement portions slidably secured within the vertical slots in the distal ends of the inner gate and the outer gate of the front section;

a sofa securement mechanism comprised of a pair of upper L-shaped brackets each having a vertical extent and a horizontal extent, the vertical extent being hingedly coupled with a lower distal end of each of the inner gate and the outer gate of the front section, the vertical extent having a receiving channel formed therein, an aperture extending through a side of the vertical extent into the receiving channel, the sofa securement mechanism having a pair of lower L-shaped brackets each having a vertical extent and a horizontal extent, the vertical extent being slidably coupled with the receiving channel, the sofa securement mechanism having a pair of adjustment knobs each extending through the aperture to secure the lower L-shaped bracket within the upper L-shaped brackets at a desired length;

a carrying case adapted to receive the portable crib in a disassembled configuration.

2. A portable crib for a sofa comprising:

a front section comprised of an inner gate and an outer gate, the inner gate being slidably received within the outer gate;

a pair of side sections, each of the side sections comprised of an inner gate and an outer gate, the inner gate being slidably received within the outer gate, each outer gate secured to the inner gate and the outer gate of the front section;

a sofa securement mechanism comprised of a pair of upper L-shaped brackets each having a vertical extent and a horizontal extent, the vertical extent being hingedly coupled with a lower distal end of each of the inner gate and the outer gate of the front section, the vertical extent having a receiving channel formed therein, an aperture extending through a side of the vertical extent into the receiving channel, the sofa securement mechanism having a pair of lower L-shaped brackets each having a vertical extent and a horizontal extent, the vertical extent being slideably coupled with the receiving channel, the sofa securement mechanism having a pair of adjustment knobs each extending through the aperture to secure the lower L-shaped bracket within the upper L-shaped brackets at a desired length.

3. The portable crib as set forth in claim 2 and further including a mattress having a generally square configuration, the mattress positionable on an upper surface of a sofa cushion.

4. The portable crib as set forth in claim 2 and further including a carrying case adapted to receive the portable crib in a disassembled configuration.

5. The portable crib as set forth in claim 2 wherein the outer gate of the front section having an aperture formed through an upper surface thereof adjacent to an open end thereof where the outer gate slidably receives the inner gate, an adjustment knob extends through the aperture to secure the inner gate within the outer gate at a desired length.

6. The portable crib as set forth in claim 2 wherein each outer gate of the pair of side sections having an aperture formed through an upper surface thereof adjacent to an open end thereof where the outer gate slidably receives the inner gate, an adjustment knob extends through the aperture to secure the inner gate within the outer gate at a desired length.

7. The portable crib as set forth in claim 2 wherein each outer gate of the pair of side sections having a hook and loop strip on the upper surface thereof.

* * * * *